United States Patent [19]

Arcilesi

[11] 4,137,133

[45] Jan. 30, 1979

[54] ACID ZINC ELECTROPLATING PROCESS AND COMPOSITION

[75] Inventor: Donald A. Arcilesi, Mount Clemens, Mich.

[73] Assignee: M&T Chemicals Inc., Stamford, Conn.

[21] Appl. No.: 860,774

[22] Filed: Dec. 15, 1977

[51] Int. Cl.[2] ..... C25D 3/22

[52] U.S. Cl. ..... 204/55 R

[58] Field of Search ..... 204/55 R, 43 Z; 106/1.29

[56] References Cited

U.S. PATENT DOCUMENTS

| | | | |
|---|---|---|---|
| Re. 27,999 | 4/1974 | Korpiun et al. | 204/55 R |
| 3,694,330 | 9/1972 | Korpiun et al. | 204/55 R |
| 3,729,394 | 4/1973 | Hsu et al. | 204/55 R |
| 3,730,855 | 5/1973 | Poor et al. | 204/55 R |
| 3,778,359 | 12/1973 | Popescu | 204/55 R |
| 3,821,095 | 6/1974 | Harbulak | 204/55 R |
| 3,855,085 | 12/1974 | Rushmere | 204/55 R |
| 3,878,069 | 4/1975 | Todt et al. | 204/55 R |
| 3,891,520 | 6/1975 | Todt et al. | 204/55 R |
| 3,919,056 | 11/1975 | Harbulak | 204/55 R |
| 3,928,149 | 12/1975 | Steeg | 204/55 R |
| 4,070,256 | 1/1978 | Hsu et al. | 204/55 R |

*Primary Examiner*—G. L. Kaplan

*Attorney, Agent, or Firm*—Kenneth G. Wheeless; Robert Spector

[57] ABSTRACT

This invention relates to a method of producing bright zinc electrodeposits over a wide current density range, which comprises passing current from a zinc anode to a metal cathode for a time period sufficient to deposit a bright zinc electrodeposit upon said cathode; the current passing through an aqueous acidic bath composition containing at least one zinc compound providing zinc cations for electroplating zinc such as zinc chloride, zinc fluoborate, zinc sulfamate and zinc sulfate; chloride, fluoborate, sulfamate and/or sulfate anions may be added as salts of bath compatible cations to provide better electrical conductivity, and containing as cooperating additives at least one bath soluble substituted or unsubstituted polyether, at least one aliphatic unsaturated acid containing an aromatic or heteroaromatic group and at least one aromatic or N-heteroaromatic aldehyde.

8 Claims, No Drawings

ACID ZINC ELECTROPLATING PROCESS AND COMPOSITION

BRIEF DESCRIPTION

This invention relates to a method and composition for producing bright zinc electrodeposits over a wide current density range. Furthermore, the electrodeposits of this invention exhibit especially outstanding leveling, ductility and receptivity to subsequent chromate conversion coatings. These advantages can be realized by visual observations of the electroplated parts or test panels.

BACKGROUND OF THE INVENTION

The enactment and enforcement of various environmental protection laws, especially those designed to improve water quality, have made it desirable to significantly reduce or eliminate the discharge of cyanides, phosphates, and a number of metal ions, from the effluents of electroplating plants. As a result, non-polluting bright zinc plating processes have been sought as alternatives to the classical zinc cyanide baths.

Alkaline solutions containing complex compounds of zinc and alkaline metal pyrophosphates have been proposed as a replacement for cyanide baths and cyanide processes for the electrodeposition of bright zinc. The electrodeposition of zinc using a pyrophosphate bath, however, may give relatively poor low current density coverage, spore formation, roughness, insufficient brightness, and relatively non-uniform deposits. In addition, passivation of the anodes may produce undesirable precipitates which in turn can clog filter systems and sometimes results in intermittent operation necessitated by frequent changes of filter media.

The use of phosphates may also produce waste disposal problems since phosphates are not easily removed and may promote the growth of undesirable aquatic plant life if discharged into streams. These disposal disadvantages further limit the acceptance of pyrophosphate zinc plating bath compositions in industrial application.

Non-cyanide zincate zinc plating baths have also been proposed as substitutes for cyanide containing systems. However, the bright plating current density range of these baths is quite limited, making the plating of articles of complex shape difficult, if not impossible. Since the addition of cyanide to these non-cyanide zincate baths greatly improves the bright plate current density range of the deposits, platers tend to add cyanides to their zincate systems, thus negating the non-cyanide feature of the original bath.

Highly acidic zinc plating baths have been known for some time and such baths are cyanide-free. These systems do not produce bright decorative deposits, (in the currently accepted usage of the word "bright"), have extremely poor low current density coverage and find their chief application in the strip line plating of wire and sheet steel using very high but narrow current density ranges. Thus, they are not suited for plating objects of complex shape or for normal decorative, or rustproofing application.

Neutral, mildly alkaline or mildly acidic non-cyanide zinc plating baths containing large amounts of buffering and complexing agents to stabilize pH and solubilize the zinc ions at the pH values involved have been employed to overcome the objections of using cyanide-based zinc plating processes.

DETAILED DESCRIPTION

This invention relates to a method of producing bright zinc electrodeposits over a wide current density range, which comprises passing current from a zinc anode to a metal cathode for a time period sufficient to deposit a bright zinc electrodeposit upon said cathode; the current passing through an aqueous acidic bath composition containing at least one zinc compound providing zinc cations for electroplating zinc such as zinc chloride, zinc fluoborate, zinc sulfamate and zinc sulfate; chloride, fluoborate, sulfamate and/or sulfate ions may be added as salts of bath compatible cations to provide better electrical conductivity, and containing as cooperating additives at least one bath soluble substituted or unsubstituted polyether, at least one aliphatic unsaturated acid containing an aromatic or heteroaromatic group and at least one aromatic or N-heteroaromatic aldehyde.

Carrier Brighteners

1.

$$H-(OCH_2CH_2)_n-OH$$

where n = 5 to 500 exemplified by polyethylene oxide having the following structure:

$$C\text{-}1 \quad H-(OCH_2CH_2)_{136}-OH$$

2.

$$R-(OC_2H_4)_n-OH$$

where R is an alkyl group containing one to about 20 carbon atoms and n = about 5 to 250 exemplified by n-lauryl polyethylene oxide having the following structure:

$$C\text{-}2 \quad C_{12}H_{25}-(OC_2H_4)_{25}-OH$$

3.

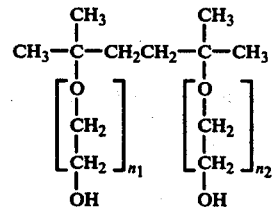

where $n_1$ and $n_2$ may be the same or different, and vary from 5 to 500 exemplified by 2,5-dimethylhexane-2,5-polyethylene oxide having the following structure:

C-3

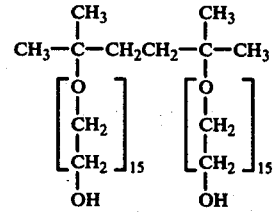

4.

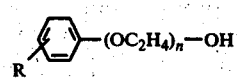

4.

where R = represents an alkyl group containing 8 to 16 carbon atoms and n = 5 to 500 exemplified by nonylphenol polyethylene glycol having the following structure:

C-4

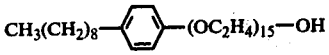

5.

$R_1—N—(C_2H_4O)_{\overline{n}}H$ where $R_1$ and $R_2$ are alkyl groups containing one to about 20 carbon atoms, which may be the same or different; $R_1$ and/or $R_2$ may also be hydrogen and n = about 5 to 250 exemplified by t-dodecylaminepolyethyleneoxide having the following structure:

C-5 $C_{12}H_{25}—NH—(C_2H_4O)_{\overline{15}}H$

6.

$H—(OC_3H_6)_{\overline{n}}OH$ where n = 5 to 50 exemplified by polypropylene glycol 700 having the following structure:

C-6 $H—(OC_3H_6)_{\overline{16}}OH$

7.

$HO—(C_2H_4O)_{\overline{n_1}}(C_3H_6O)_{\overline{n_2}}(C_2H_4O)_{\overline{n_3}}H$ where $n_1 + n_2$ equals about 5 to 300 and $n_2$ equals about 5 to 50 exemplified by the polyethylene polypropylene copolymer having the following structure:

C-7 $HO—(C_2H_4O)_5—(C_3H_6O)_{\overline{30}}(C_2H_4O)_5—H$

8.

$HO—(C_3H_6O)_{\overline{n_1}}(C_2H_4O)_{\overline{n_2}}(C_3H_6O)_{\overline{n_3}}H$ where $n_1 + n_3$ equals about 2 to 50 and $n_2$ equals about 50 to 300 exemplified by the following structure:

C-8 $HO—(C_3H_6O)_9—(C_2H_4O)_{\overline{91}}(C_3H_6O)_{\overline{9}}H$

9. The bath soluble polyethers of this invention which may be used in amounts of about 1 to 50 g/l (preferably about 2 to 20 g/l) include polyethers of the following general types:

$C_nH_{\overline{2n+1}}(OC_3H_6)_{\overline{m}}(OC_2H_4)_{\overline{p}}OH$ where n = 6 to 14, m = 1 to 6, p = 10 to 20 exemplified by propoxylated and ethoxylated lauryl alcohol having the following structure:

C-9 $CH_3(CH_2)_{\overline{11}}(OC_3H_6)_{\overline{3}}(OC_2H_4)_{\overline{15}}OH$

Auxiliary Brighteners

The bath soluble auxiliary brighteners of this invention, which may be used in amounts of about 0.01 to 10 g/l (preferably about 0.1 to 1 g/l), are aliphatic unsaturated acids containing an aromatic or heteroaromatic group and are of the general structure:

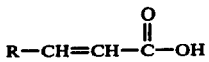

where R is an aromatic or heteroaromatic moiety.

A few representative compounds of the above type are:

A-1 cinnamic acid: 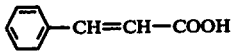

A-2 o-hydroxycinnamic acid: 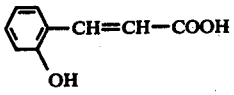

A-3 o-methoxycinnamic acid: 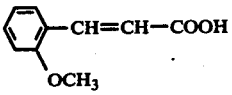

A-4 p-methoxycinnamic acid: 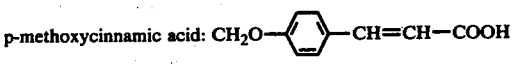

A-5 p-aminocinnamic acid: 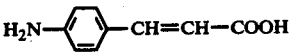

A-6 o-nitrocinnamic acid: 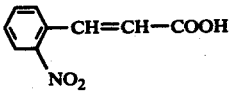

A-7 m-nitrocinnamic acid: 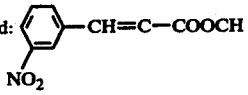

A-8 p-nitrocinnamic acid: 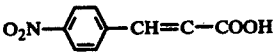

A-9 o-chlorocinnamic acid: 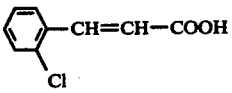

A-10

2,4-dichlorocinnamic acid: 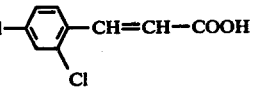

A-11 o-carboxycinnamic acid: 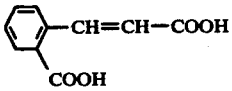

A-12

α-phenylcinnamic acid: 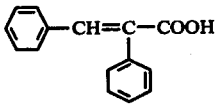

-continued

A-13

β-(2-furyl)acrylic acid: 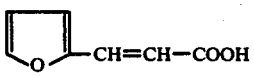

A-14

β-(3-pyridyl)acrylic acid: 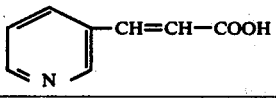

Primary Brighteners

The bath soluble primary brighteners of this invention, which may be used in amounts of about 0.001 to 10 g/l (preferably about 0.1 to 1 g/l), are aromatic or N-heteroaromatic aldehydes (in which case one or more of the

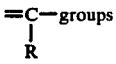

is replaced by —N=) of the general structure:

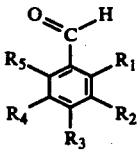

where $R_1$ to $R_5$ may be H, alkyl groups with 1 to 5 carbon atoms such as $—CH_3$, alkoxy groups with 1 to 4 carbons such as $—OCH_3$, or —OH, $—NH_2$, —Cl, —COOH, $—NO_2$, $—SO_3$ groups and where two vicinal R groups may be represented by a $—OCH_2O—$ group or a —CH=CH—CH—CH— group; the carbonyl group may be joined to the aromatic moiety by a vinylene (—CH=CH—) group.

P-1 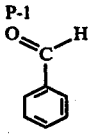 benzaldehyde

P-2 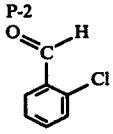 2-chlorobenzaldehyde

P-3 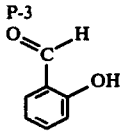 2-hydroxybenzaldehyde

P-4 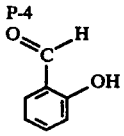 2,4-dihydroxybenzaldehyde

P-5 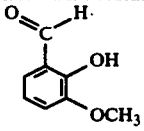 2-hydroxy-3-methoxybenzaldehyde

P-6 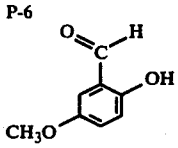 2-hydroxy-5-methoxybenzaldehyde

P-7 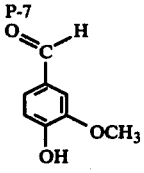 3-methoxy-4-hydroxybenzaldehyde

P-8 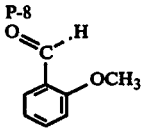 2-methoxybenzaldehyde

P-9 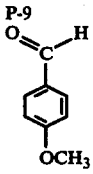 4-methoxybenzaldehyde

P-10 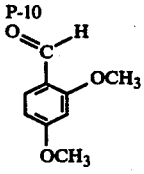 2,4-dimethoxybenzaldehyde

P-11 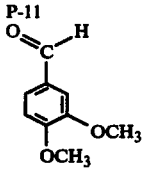 3,4-dimethoxybenzaldehyde

P-12 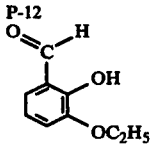 2-hydroxy-3-ethoxybenzaldehyde

P-13 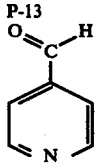 nicotinaldehyde

P-14 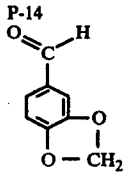 piperonal

-continued

| | | |
|---|---|---|
| P-15 | 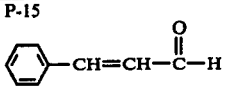 | cinnamaldehyde |
| P-16 | 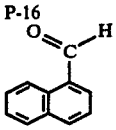 | 1-naphthaldehyde |
| P-17 | 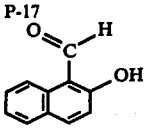 | 2-hydroxy-1-naphthaldehyde |
| P-18 | 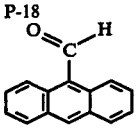 | 9-anthraldehyde |

It should be noted that most of the aldehydes of this invention are not very water soluble as such. However, the sodium bisulfite adducts of these aldehydes are very water-soluble. These adducts are useful in preparing additive concentrates to be added to the plating solution. The bisulfite itself does not affect the performance of the aldehyde in the plating solution.

The bisulfite adduct is formed in accordance with the following general equation:

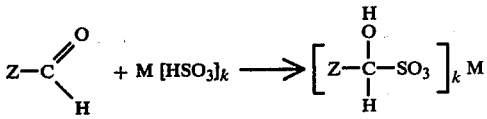

wherein M is a cation having a valence of 1–2; preferably M is an alkali metal or alkaline earth metal cation or ammonium; K is one or two, corresponding to the valence of M; and Z is an aromatic or N-heteroaromatic group of the general structure:

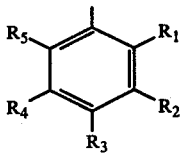

previously described.

EXAMPLES

The acid zinc examples of this invention were prepared as follows:

Acid Zinc Electrolyte

First a mixing vessel was filled half-way to the desired final volume with distilled water.

Then a zinc compound, such as zinc chloride, zinc fluoborate, zinc sulfamate, zinc sulfate, or combinations of zinc compounds, was mixed into the water so as to function as a source of metal ions for subsequent electrodeposition.

Next an alkali metal salt, such as potassium chloride, a fluoborate, sulfamate and/or sulfate anions which are salts of bath compatible cations, may be added to the above mixture to provide high electrical conductivity to the electrolyte during subsequent electrodeposition.

To the above mixture a buffering agent, such as boric acid, was then added so that the pH of the final electrolyte could ultimately be easily maintained between approximately 5 and 6. The pH should be maintained between approximately 5 and 6 because as the pH of the electrolyte drops below about 5, the zinc anodes begin to dissolve excessively, and at a pH of about 6 zinc hydroxide forms and precipitates out of the electrolyte. It should be noted that as the bath is electrolyzed the pH will slowly rise. It can be lowered by adding concentrated hydrochloric acid. If it is necessary to raise the pH, it can be raised by adding a solution of sodium hydroxide.

After the zinc compound, the conducting salt and the buffering agent are mixed together, the mixture is raised to its final volume, and after all of the constituents are dissolved, the mixture is filtered. This filtered mixture is an acid zinc electrolyte without grain refining additives.

Acid zinc Grain Refining agents

To the acid zinc electrolyte, grain refining additives are added in the following order:

First, the carrier brighteners are added to the electrolyte which is mixed until they are dissolved. The carrier brighteners of this invention produce primary grain refining.

Next, the auxiliary brighteners, which produce secondary grain refining and also help to solubilize subsequent primary brighteners, are added to the electrolyte which is mixed until they are dissolved.

Finally, the primary brighteners, which produce tertiary grain refining — i.e., these compounds can synergistically produce a very high degree of brightness — in combination with the other components of the system, are added to the electrolyte which is mixed until they are dissolved.

PLATING

The examples of this invention were evaluated in 267 ml Hull Cells and in 4 liter rectangular plating cells as follows:

Hull Cell Tests

Hull Cell tests were run under conditions described as follows:

A polished steel or brass panel was scribed with a horizontal singl pass of 4/0 grip emery to give a band width of about 1 cm at a distance of about 2.5 cm from the bottom of the panel. After suitably cleaning the panel, it was plated in a 267 ml Hull Cell, at a 2 ampere cell current for 5 minutes, at a temperature of 20° C. using magnetic stirring and a 99.99+% pure zinc sheet as an anode.

4 Liter Plating Cell

The 4 liter plating cell tests were run under the following conditions:

Plating cell — 5 liter rectangular cross-section (13 cm × 15 cm) made of Pyrex.

Solution volume — 4 liters to give a solution depth, in absence of anode, of about 20.5 cm.

Temperature — 20° C. (maintained by immersing cell in a thermostatically controlled water bath).

Agitation — bubbling air.

Anode — 99.99+% zinc balls, 5 cm in diameter strung on titanium wire — 5 balls per cell.

Cathode — brass strip (2.54 cm × 20.3 cm × 0.071 cm) buffed and polished on one side and immersed to a depth of about 17.8 cm — horizontal bend 2.54 cm from bottom and the next 2.54 cm bent to give an internal angle on the polished side of cathode of about 45° — polished side facing anode at an approximate distance of 10.2 cm and scribed vertically in center with a 1 cm wide band of a single pass of 4/0 grit emery paper scratches.

Cell current — 2.0 to 5.0 amperes.

Time — 5 minutes to 8 hours per day.

Some deposits were plated for 5 to 15 minutes to give normally utilized thicknesses of zinc (0.2 to 0.5 mil or 5.1 to 12.7 microns) while other deposits were plated for as long as 7 to 8 hours to observe physical properties such as ductility, tensile stress, etc. and to provide sufficient electrolysis to deplete some of the organic additives.

GENERAL OPERATING CONDITIONS

Cathode current densities may range from about 0.1 to 5.0 amperes per square decimeter (ASD) depending on whether the plating is done in barrels or on racks and on such factors as concentration of bath zinc metal, conducting salts, buffers, etc., and on the degree of cathode agitation. Anode current densities also may range from about 0.5 to 3.0 ASD depending on bath ingredient concentrations, degree of solution circulation around the anodes, etc.

The operating temperature of the baths are ambient temperatures ranging from about 15 to 40° C. Agitation is of the moving cathode rod type or involving the use of air.

Anodes generally consist of 99.99+% pure zinc which may be immersed in the plating bath in baskets made of an inert metal such as titanium or which may be suspended in the bath by titanium hooks hanging on the anode bars.

The plating baths may be used for rack or barrel plating purposes. The basis metals generally plated are ferrous metals such as steel or cast iron to be zinc plated for protection against rusting by a cathodic protection mechanism and also for providing decorative eye appeal. To further enhance the protective action of the zinc, the zinc after plating may be subjected to a conversion coating treatment, generally by immersion or anodic electrolytic action in baths containing hexavalent chromium, catalysts, accelerators, etc. The conversion coating treatment may enhance the luster of the zinc as plated by a chemical or electropolishing action as well as providing a conversion coating film consisting of a mixture of Cr VI, CR III and Zn compounds ranging in color from very light iridescent, to blue, to iridescent yellow to olive drab etc. The more highly colored coatings are thicker and may provide better corrosion protection in humid saline atmospheres. To further enhance protective action, usually on the more transparent, lighter colored films, there may be applied lacquer coatings, air dried or baked. To some of the thinner, lighter-colored conversion coating there may be applied a more intense and varied color by immersion in solutions of suitable dyestuffs to give pure jet black to pastel range of colors which may then be followed by lacquer coatings to apply protection against abrasion, finger staining etc., in use.

During the plating operation, it is desirable to keep metallic contaminants at very low concentration levels in order to insure a bright zinc electrodeposit. Such contamination from metal ions, (such as cadmium, copper, iron, and lead) may be reduced or eliminated through conventional purification methods. Other types of contaminants (such as organic contaminants) may also be eliminated or reduced by circulation of the zinc electroplating solution through suitable filter media such as activated carbon or types of ion exchange or absorption media.

The following examples are submitted to further the understanding of the operation of the invention and should not be construed so as to limit its scope.

In order to more fully understand the synergistic effects of the three classes of additives involved, the same electrolyte composition was used in the subsequent examples of this invention.

EXAMPLE I

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-1 | 10 g/l |
| A-3 | 0.75 g/l |
| P-5 | 0.2 g/l |
| P-9 | 0.1 g/l |

Bent cathodes and Hull Cell panels electroplated in the solution of Example I are bright, extremely ductile and exhibit a moderate degree of leveling over current densities from about 0 to 20 ASD.

EXAMPLE II

An acid zinc electroplating bath was prepared having the following composition:

| | |
|---|---|
| Electrolyte: | |
| $ZnCl_2$ | 100 g/l |
| KCl | 200 g/l |
| $K_3BO_3$ | 20 g/l |
| pH | adjusted to 5.5 |
| Additives: | |
| C-3 | 15 g/l |
| A-12 | 0.4 g/l |
| P-5 | 0.2 g/l |

Bent cathodes and Hull Cell panels electroplated in the solution of Example II are bright from 0 to 6 ASD and hazy bright from 6 to 20 ASD. The leveling is weak and the ductility is moderate. There is a tendency to pit in the medium current density areas. It should be noted that much of the A-12 is in solution as a fine suspension - not fully dissolved. The solution is turbid. If the concentration of C-3 is raised to 30 g/l most of the A-12 dissolves, but the solution is still slightly turbid. (See Example III).

EXAMPLE III

An acid zinc electroplating bath was prepared having the following composition:

| | |
|---|---|
| Electrolyte: | |
| $ZnCl_2$ | 100 g/l |
| KCl | 200 g/l |

-continued

| | |
|---|---|
| $H_3BO_3$ | 20 g/l |
| pH | adjusted to 5.5 |
| Additives: | |
| C-3 | 15 g/l |
| reaction product of naphthalene sulfonic acid and formaldehyde | 10 g/l |
| A-12 | 0.4 g/l |
| P-5 | 0.2 g/l |

Bent cathodes and Hull Cell panels electroplated in the solution of Example III are similar to those of Example II except that they are brighter and free of pits. It should be noted that the presence of the reaction product of naphthalene sulfonic acid and formaldehyde caused the rapid and complete dissolution of the A-12.

EXAMPLE IV

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-4 | 10 g/l |
| A-1 | 0.3 g/l |
| P-3 | 0.15 g/l |

Bent cathodes and Hull Cell panels electroplated in the solution of Example IV are hazy bright from 0 to 4 ASD, mirror bright from 4 to 20 ASD, and exhibit good leveling and ductility.

EXAMPLE V

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-5 | 10 g/l |
| A-1 | 0.5 g/l |
| P-3 | 0.1 g/l |

Bent cathodes and Hull Cell panels electroplated in the solution of Example V have a lustrous hazy bright appearance from 0 to 20 ASD, good ductility and weak leveling.

EXAMPLE VI

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-5 | 10 g/l |
| A-1 | 0.75 g/l |
| P-18 | 0.05 g/l |

Bent cathodes and Hull Cell panels electroplated in the solution of Example VI have a very uniform hazy bright plate from 0 to 20 ASD, with weak leveling and good ductility.

EXAMPLE VII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-13 | 0.5 g/l |
| P-3 | 0.3 g/l |

Bent cathodes and Hull Cell panels electroplated in the solution of Example VII have excellent brightness, leveling and ductility from 0 to 20 ASD.

EXAMPLE VIII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-13 | 0.15 g/l |
| A-1 | 0.5 g/l |
| P-3 | 0.2 g/l |

Bent cathodes and Hull Cell panels electroplated in the solution of Example VIII have outstanding brightness, leveling and ductility from 0 to 20 ASD.

EXAMPLE IX

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.75 g/l |
| P-3 | 0.3 g/l |

Bent cathodes and Hull Cell panels electroplated in the solution of Example IX are very bright with excellent leveling and ductility from 0 to 20 ASD.

EXAMPLE X

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-9 | 0.6 g/l |
| P-3 | 0.3 g/l |

Bent cathodes and Hull Cell panels electroplated in the solution of Example X are very bright with excellent leveling and ductility from 0 to 20 ASD.

EXAMPLE XI

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-3 | 0.6 g/l |
| P-3 | 0.2 g/l |

Bent cathodes and Hull cell panels electroplated in the solution of Example XI are very bright with excellent ductility from 0 to 20 ASD.

EXAMPLE XII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-4 | 0.6 g/l |
| P-3 | 0.35 g/l |

Bent cathodes and Hull Cell panels electroplated in the solution of Example XII are bright with very good leveling and excellent ductility from 0 to 20 ASD.

EXAMPLE XIII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-5 | 0.75 g/l |
| P-3 | 0.3 g/l |

Bent cathodes and Hull Cell panels electroplated in the solution of Example XIII are bright with good leveling and excellent ductility from 0 to 10 ASD, but rather dull above 10 ASD.

EXAMPLE XIV

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-12 | 0.75 g/l |
| P-3 | 0.2 g/l |

Bent cathodes and Hull Cell panels electroplated in the solution of Example XIV are bright with excellent ductility from 0 to 20 ASD and exhibit weak leveling.

EXAMPLE XV

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.3 g/l |
| P-15 | 0.3 g/l |

Bent cathodes and Hull Cell panels electroplated in the solution of Example XV have a uniform semi-bright appearance, weak leveling and very good ductility.

EXAMPLE XVI

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.3 g/l |
| P-13 | 0.1 g/l |

Bent cathodes and Hull Cell panels electroplated in the solution of Example XVI are bright from 0 and 1 ASD, hazy from 1 to 4 ASD, bright from 4 to 20 ASD and exhibit weak leveling and moderate ductility.

EXAMPLE XVII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| P-14 | 0.1 g/l |

Bent cathodes and Hull Cell panels electroplated in the solution of Example XVII are uniformly semi-bright with weak leveling and excellent ductility. After the above zinc plated cathodes were processed through a proprietary conversion coating solution, such as those that may be prepared using the Unichrome* Dip Compound 1086, they had a brilliant blue bright appearance, even though they had only been hazy-bright prior to the application of the conversion coating.

*Trademark of M&T Chemicals Inc.

EXAMPLE XVIII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |

-continued

| | |
|---|---|
| A-1 | 0.5 g/l |
| P-2 | 0.1 g/l |

Bent cathodes and Hull Cell panels electroplated in the solution of Example XVIII are hazy bright from 0 to 7 ASD, intensely bright from 7 to 20 ASD with good ductility and weak leveling.

EXAMPLE XIX

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| P-9 | 0.1 g/l |

Bent cathodes and Hull Cell panels electroplated in the solution of Example XIX are uniformly semi-bright after plating but the application of a conversion coating, produced via the Unichrome* Dip Compound 1086, produced mirror bright deposits from 0 to 20 ASD with weak leveling characteristics but good ductility.

* Trademark of M&T Chemicals Inc.

EXAMPLE XX

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| P-5 | 0.3 g/l |

Bent cathodes and Hull Cell panels electroplated in the solution of Example XX have outstanding brightness, leveling and ductility from 0 to 20 ASD.

EXAMPLE XXI

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| sodium bisulfite adduct of P-6 | 0.4 g/l |

Bent cathodes and Hull Cell panels electroplated in the solution of Example XXI have excellent brightness, leveling and ductility from 0 to 20 ASD.

EXAMPLE XXII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| P-12 | 0.4 g/l |

Bent cathodes and Hull Cell panels electroplated in the solution of Example XXII have excellent brightness, leveling and ductility from 0 to 20 ASD.

EXAMPLE XXIII

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.5 g/l |
| P-4 | 0.2 g/l |

Bent cathodes and Hull Cell panels electroplated in the solution of Example XXIII are hazy bright from 0 to 3 ASD, very bright from 3 to 20 ASD with moderate leveling characteristics but excellent ductility.

EXAMPLE XXIV

An acid zinc electroplating bath was prepared having the following composition:

| | |
|---|---|
| Electrolyte: | |
| $ZnCl_2$ | 100 g/l |
| KCl | 200 g/l |
| $H_3BO_3$ | 20 g/l |
| pH | adjusted to 5.5 |
| Additives: | |
| C-9 | 10 g/l |
| A-1 | 0.75 g/l |
| P-3 | 0.2 g/l |
| P-18 | 0.05 g/l |

Bent cathodes and Hull Cell panels electroplated in the solution of Example XXIV have excellent brightness, leveling and ductility.

What is claimed is:

1. A method of producing bright zinc electrodeposits over a wide current density range, which comprises passing current from a zinc anode to a metal cathode for a time period sufficient to deposit a bright zinc electrodeposit upon said cathode; the current passing through an aqueous acidic bath composition containing at least one zinc compound providing zinc cations for electroplating zinc and containing as cooperating additives 1 to 50 g/l of at least one bath soluble substituted or unsubstituted polyether, 0.01 to 10 g/l of at least one aliphatic unsaturated acid containing an aromatic or heteroaromatic group and 0.001 to 10 g/l of at least one aromatic or N-heteroaromatic aldehyde.

2. The process of claim 1 wherein said polyether is an alkyl propoxyethoxy polyether of the general structure:

$$C_nH_{2n+1}(OC_3H_6)_{m1}(OC_2H_4)_{m2}OH$$

where n is 6 to 14; $m_1$ is 1 to 6; $m_2$ is 10 to 20.

3. The process of claim 1 wherein at least one aliphatic unsaturated acid containing an aromatic or heteroaromatic group is of the general structure:

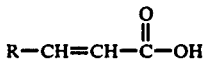

where R is an aromatic or heteroaromatic moiety.

4. The process of claim 1 wherein at least one aromatic or N-heteroaromatic aldehyde (in which case one or more of the

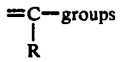

is replaced by —N=) is of the general structure:

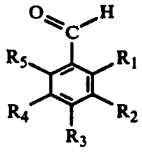

where each $R_1$ to $R_5$ is selected from the group consisting of H, alkyl groups with 1 to 5 carbon atoms, alkoxy groups with 1 to 4 carbon atoms, —OH, —$NH_2$, —Cl, —COOH, —$NO_2$, —$SO_3$ —groups provided that two vicinal R groups may be represented by a —$OCH_2O$— group or a —CH=•CH—CH=CH— group; the carbonyl group may be joined to the aromatic moiety by a vinylene (—CH=CH—) group.

5. A composition for producing bright zinc electrodeposits over a wide current density range, which comprises an aqueous acidic bath composition containing at least one zinc compound providing zinc cations for electroplating zinc and containing as cooperating additives 1 to 50 g/l of at least one bath soluble substituted or unsubstituted polyether, 0.01 to 10 g/l of at least one aliphatic unsaturated acid containing an aromatic or heteroaromatic group and 0.001 to 10 g/l of at least one aromatic or N-heteroaromatic aldehyde.

6. The composition of claim 5 wherein said polyether is an alkyl propoxyethoxy polyether of the general structure: $C_nH_{2n+1}(OC_3H_6)_{m1}(OC_2H_4)_{m2}OH$ where n is 6 to 14; $m_1$ is 1 to 6; $m_2$ is 10 to 20.

7. The composition of claim 5 wherein at least one aliphatic unsaturated acid containing an aromatic or heteroaromatic group is of the general structure:

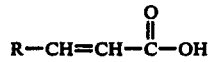

where R is an aromatic or heteroaromatic moiety.

8. The composition of claim 5 wherein at least one aromatic or N-heteroaromatic aldehyde (in which case one or more of the

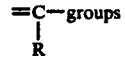

is replaced by —N=) is of the general structure:

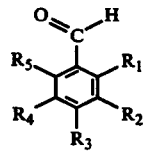

where each $R_1$ to $R_5$ is selected from the group consisting of H, alkyl groups with 1 to 5 carbon atoms, alkoxy groups with 1 to 4 carbon atoms, —OH, —$NH_2$, —Cl, —COOH, —$NO_2$, —$SO_3$ —groups provided that two vicinal R groups may be represented by a —$OCH_2O$— group or a —CH=•CH—CH=CH— group; the carbonyl group may be joined to the aromatic moiety by a vinylene (—CH=CH—) group.

* * * * *